US007033310B2

(12) United States Patent
Succi et al.

(10) Patent No.: US 7,033,310 B2
(45) Date of Patent: Apr. 25, 2006

(54) UNIT FOR PROCESSING A WEB OF PACKAGING MATERIAL

(75) Inventors: Omar Succi, Modena (IT); Sebastian Heinonen, Lund (SE); Remo Amadei, Modena (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 10/312,835

(22) PCT Filed: Jul. 6, 2001

(86) PCT No.: PCT/EP01/07772

§ 371 (c)(1),
(2), (4) Date: Jan. 3, 2003

(87) PCT Pub. No.: WO02/04296

PCT Pub. Date: Jan. 17, 2002

(65) Prior Publication Data

US 2004/0038789 A1 Feb. 26, 2004

(30) Foreign Application Priority Data

Jul. 7, 2000 (EP) ..... 00830479

(51) Int. Cl.
*B31B 1/00* (2006.01)

(52) U.S. Cl. ..... 493/10; 493/11

(58) Field of Classification Search ..... 493/10, 493/11; 53/133.5, 133.7, 412, 415, 419
See application file for complete search history.

(56) References Cited

U.S. PATENT DOCUMENTS

| | | | |
|---|---|---|---|
| 3,325,335 | A | 6/1967 | Martensson |
| 3,899,112 | A | 8/1975 | Stark et al. |
| 3,929,045 | A | 12/1975 | Pålsson |
| 3,971,192 | A | 7/1976 | Soukup et al. |
| 4,017,247 | A | 4/1977 | Soukup et al. |
| 4,043,520 | A | 8/1977 | Olsson et al. |
| 4,174,200 | A | 11/1979 | Hoj |
| 4,203,796 | A | 5/1980 | Larsson |
| 4,217,085 | A | 8/1980 | Ljungberg et al. |
| 4,261,939 | A | 4/1981 | Nilsson et al. |
| 4,266,389 | A | 5/1981 | Linde et al. |
| 4,371,364 | A | 2/1983 | Rausing |

(Continued)

FOREIGN PATENT DOCUMENTS

WO 98/18609 A1 5/1998

*Primary Examiner*—Eugene Kim
(74) *Attorney, Agent, or Firm*—Buchanan Ingersoll PC

(57) ABSTRACT

A unit (1) for processing a web (2) of packaging material, and having at least a first station (3) for forming a number of through holes (4) in the web (2); a second station (6) for sealing the holes by applying respective opening devices (7, 8); a feed device (10) for step feeding the web (2) along a path (P) through the first and second station (3, 6); a position sensor (21) generating a presence signal (S) indicating the passage, past the sensor (21), of reference elements (C; 4) carried by the web (2) and bearing a predetermined relationship with the holes (4); a control device (20) for controlling the feed device (10) in response to the presence signal (S); and actuating means (22) cooperating with the second station (6) to move the second station in a direction parallel to said path (P), and activated by the control device (20) to adjust the position of the second station (6) as a function of the presence signal (S).

33 Claims, 3 Drawing Sheets

U.S. PATENT DOCUMENTS 4,401,250 A 8/1983 Carlsson
4,495,016 A 1/1985 Viberg et al.
4,580,392 A 4/1986 Lagerstedt et al.
4,755,412 A 7/1988 Glans et al.
4,782,987 A 11/1988 Giacomelli et al.
4,814,043 A 3/1989 Rausing et al.
4,838,468 A 6/1989 Lesse
5,161,350 A * 11/1992 Nakamura ..... 53/412
5,390,779 A * 2/1995 Spatafora ..... 198/458
5,733,236 A * 3/1998 De Smedt ..... 493/8
5,833,107 A * 11/1998 Terranova et al. ..... 226/31
5,894,707 A * 4/1999 May ..... 53/133.7
6,036,803 A 3/2000 Lasson et al.
6,217,497 B1 * 4/2001 Laudenberg ..... 493/11
6,254,519 B1 * 7/2001 Toshima ..... 493/214
6,319,182 B1 * 11/2001 Schneider ..... 493/10
6,386,851 B1 5/2002 Gustafsson
6,820,399 B1 * 11/2004 Send ..... 53/471

* cited by examiner

UNIT FOR PROCESSING A WEB OF PACKAGING MATERIAL

FIELD OF THE INVENTION

The present invention relates to a unit for processing a web of packaging material for producing sealed packages of pourable food products.

BACKGROUND OF THE INVENTION

As is known, many pourable food products, such as fruit juice, pasteurized or UHT (ultra-high-temperature processed) milk, wine, tomato sauce, etc., are sold in packages made of sterilized packaging material.

A typical example of such a package is the parallelepiped-shaped package for liquid or pourable food products known as Tetra Brik Aseptic (registered trademark), which is formed by folding and sealing a web of laminated packaging material. The packaging material has a multilayer structure comprising a layer of fibrous material, e.g. paper, covered on both sides with layers of heat-seal plastic material, e.g. polyethylene. In the case of aseptic packages for long-storage products, such as UHT milk, the packaging material also comprises a layer of oxygen-barrier material defined, for example, by an aluminium film, which is superimposed on a layer of heat-seal plastic material and is in turn covered with another layer of heat-seal plastic material eventually defining the inner face of the package contacting the food product.

As is known, such packages are made on fully automatic packaging machines, on which a continuous tube is formed from the packaging material supplied in web form.

More specifically, the web of packaging material is sterilized and then fed to a forming unit on which it is folded and sealed longitudinally to form a vertical tube. The tube is filled with the sterilized or sterile-processed food product, and is sealed by pairs of jaws and subsequently cut at equally spaced cross sections to form pillow packs, which are then folded mechanically to form the finished, e.g. substantially parallelepiped-shaped, packages.

Upstream from the forming unit, the web of packaging material may be fed through a processing unit for performing various auxiliary operations, which, when producing packages with opening devices, such as pull-off tabs, screw or hinged caps, may comprise, for example, perforation of a number of through openings or holes at predetermined points on the web, and one or more operations to fix the opening devices over the holes.

The most commonly used opening devices comprise a patch defined by a small sheet of heat-seal plastic material, and which is heat sealed over a respective hole on the side of the web eventually forming the inside of the package; and a pull-off tab applied to the opposite side of the packaging material and heat sealed to the patch. The tab and patch adhere to each other, so that, when the tab is pulled off, the portion of the patch heat sealed to it is also removed to uncover the hole.

To close the package once the tab is pulled off, the portion of the packaging material surrounding the tab is normally fitted with a frame element normally made of plastic material and supporting a removable, e.g. screw or hinged, cap for closing the respective hole.

Alternatively, closable opening devices are also known to be applied by injecting plastic material directly onto the holes in the web, as described, for example, in Patent WO 98/18609.

On known machines, the web of packaging material is fed in steps through the processing unit by a feed system comprising feed rollers controlled by a servomotor in turn controlled in response to a signal generated by an optical sensor for detecting a reference element, normally a pre-printed marker such as a bar code, repeated at predetermined intervals along the web.

In the case of processing units comprising a punch station, and two heat-seal stations for applying the patches and pull-off tabs respectively, a high degree of precision is required in positioning the web, especially at the tab seal station.

That is, to ensure perfect sealing of the holes in the web, the size of the patches and tabs must be proportional to the maximum offset between the work position of the heat-seal stations and the holes themselves. The size of the tabs, however, is a critical parameter, which directly determines the size of the frames and caps applied to the tabs, and which must therefore be kept as small as possible to avoid the obvious disadvantages in using relatively large caps.

Similarly, when the processing unit comprises, in addition to the punch station, a station for injection molding closable opening devices directly onto the respective holes in the web, the portion of the web surrounding each hole must be positioned correctly inside the molding cavity, to ensure correct flow of the thermoplastic material injected into the cavity and, hence, correct sealing of the edge of the hole on both sides of the web.

A demand therefore exists within the industry for even greater precision in processing the web at each station on the unit.

SUMMARY OF THE INVENTION

It is an object of the present invention to provide a unit for processing a web of packaging material for producing sealed packages of pourable food products, and which provides for a high degree of precision in the performance of at least two successive operations on the same portion of the web.

According to the present invention, there is provided a unit for processing a web of packaging material for producing sealed packages of pourable food products, said unit comprising at least a first station for forming a number of through holes in said web; a second station for sealing said holes by applying respective opening devices by which to open the packages; a feed device for step feeding said web along a path through said first and said second station; a position sensor generating a presence signal indicating the passage, past the sensor, of reference elements on said web; and control means for controlling said feed device in response to said presence signal; characterized in that said reference elements bear a predetermined relationship with said holes in said web; said unit also comprising actuating means cooperating with said second station to move the second station in a direction parallel to said path, and activated by said control means to adjust the position of the second station as a function of said presence signal.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
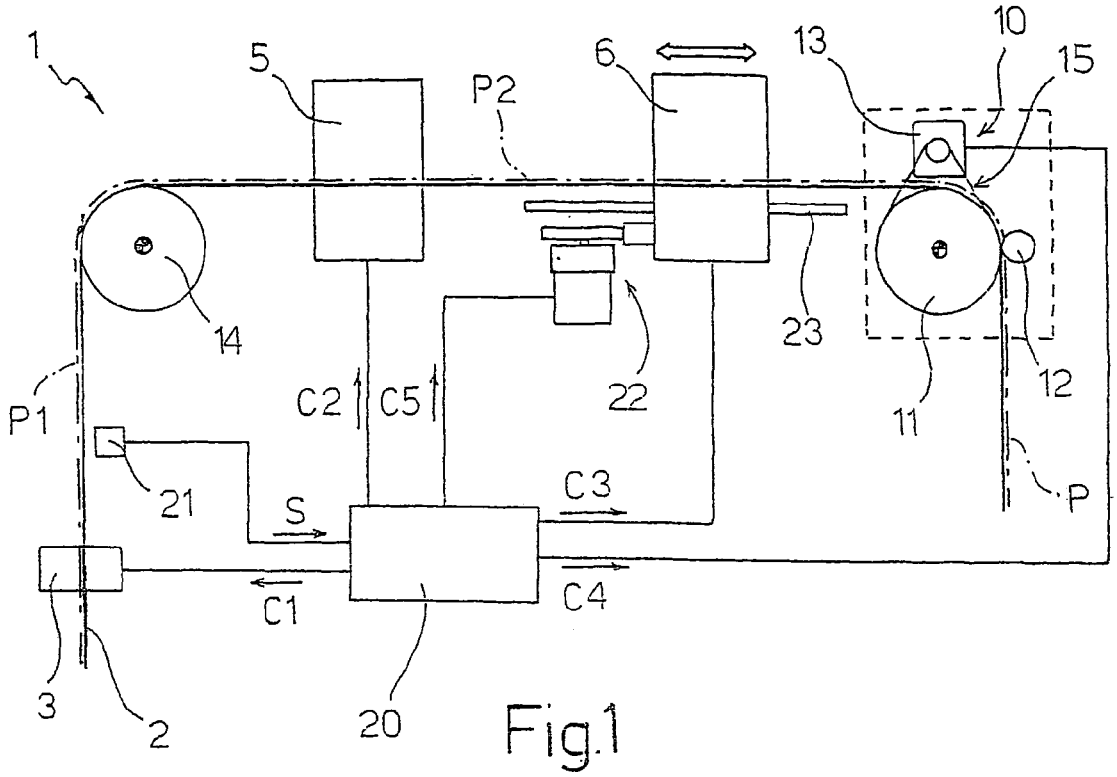
FIG. 1 shows a schematic side view of a unit, in accordance with the present invention, for processing a web of packaging material for producing sealed packages of pourable food products.

Number 1 in FIG. 1 indicates as a whole a unit, in accordance with the present invention, for processing a web 2 of packaging material for producing sealed packages (not shown) of pourable food products, such as pasteurized or UHT milk, fruit juice, wine, etc.

Unit 1 may be incorporated in a packaging machine (not shown) for continuously producing said packages from web 2 of packaging material. More specifically, web 2 is folded and sealed longitudinally in known manner to form a vertical tube, which is filled with the sterilized or sterile-processed food product, is sealed at equally spaced cross sections, and undergoes successive mechanical folding operations to form the finished packages.

Figure 4:
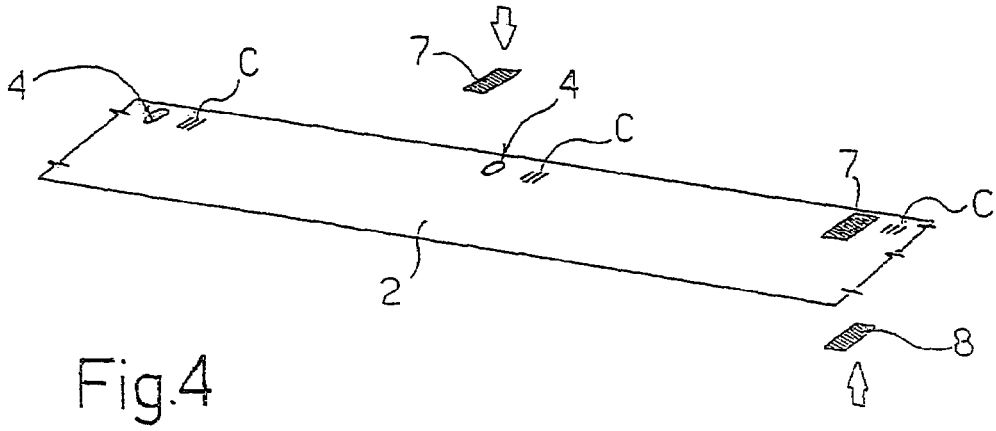
FIG. 4 shows a view in perspective of a portion of the web during processing.

Web 2 is fed through unit 1 along a path P, and is provided on one face with a number of optically detectable reference elements, e.g. preprinted markers conveniently including respective bar codes C (FIG. 4) equally spaced along path P with a spacing equal to the length of web 2 used to produce one package, minus inevitable production tolerances of web 2.

Web 2 of packaging material has a multilayer structure, and substantially comprises a layer of fibrous material, e.g. paper, covered on both sides with respective layers of heat-seal plastic material, e.g. polyethylene. The side of web 2 eventually forming the inner face of the package and so contacting the food product also has a layer of barrier material defined, for example, by an aluminium film in turn covered on both sides with respective layers of heat-seal plastic material, e.g. polyethylene.

Unit 1 comprises a known punch station 3 (shown only schematically) located along a first vertical portion P1 of path P, and where web 2 is punched to form a number of openings or holes 4 (FIG. 4)—in the example shown, substantially ogival in shape—equally spaced along path P with a spacing equal to the length of the packaging material used to form one package, minus said production tolerances of web 2.

Unit 1 also comprises, downstream from station 3 and in series along a second horizontal portion P2 of path P, a first and a second station 5, 6 (known and only shown schematically) for respectively applying a patch 7 and a pull-off tab 8 to each hole 4 and on opposite faces of web 2.

More specifically, patches 7 are defined by small rectangular sheets of heat-seal plastic material, and are heat sealed at station 5 over respective holes 4 on the face of web 2 eventually forming the inside of the packages; and tabs 8 are also made of heat-seal plastic material, are rectangular, and are heat sealed at station 6 to respective patches 7 on the face of web 2 eventually forming the outside of the packages. More specifically, at the end of the operations performed at stations 5 and 6, each tab 8 projects outwards with respect to respective hole 4 in web 2, and is joined to respective patch 7 over a sealing area extending close to and inwards of a lateral edge of hole 4 and defining a tear portion of patch 7, which is removed when tab 8 is pulled off.

Like web 2 of packaging material, each tab 8 has a multilayer structure, and is defined by a layer of heat-seal plastic material, e.g. polyethylene, one face of which eventually adheres to respective patch 7; and by a layer of barrier material, normally aluminium, which is fixed to the layer of heat-seal plastic material on the opposite side to patch 7.

Unit 1 also comprises a feed device 10 for step feeding web 2 along path P through stations 3, 5 and 6.

More specifically, feed device 10 comprises two rollers 11, 12, which cooperate with opposite faces of web 2, define a downstream end of portion P2 of path P, and are controlled by a servomotor 13; and web 2 is guided from portion P1 to portion P2 of path P by an idle guide roller 14.

More specifically, roller 11 is controlled by servomotor 13 via a first, e.g. toothed-belt, transmission 15, and in turn controls roller 12 via a second, e.g. gear, transmission (not shown).

Feed device 10—and more specifically servomotor 13—is controlled by a control device 20 in response to a presence signal S generated by a position sensor 21, e.g. a photocell, located along path P, and indicating the passage, past sensor 21, of codes C on web 2.

More specifically, sensor 21 is located close to—in the example shown, downstream from—station 3 along path P, so that the distance between each hole 4, formed at station 3, and respective code C is unaffected by the inevitable pull on web 2 through unit 1, and detection of codes C by sensor 21 corresponds extremely accurately to detection of the respective holes 4.

Presence signal S assumes a first, e.g. high, logic level as a code C on web 2 travels past sensor 21; and a second, e.g. low, logic level in any other condition.

An important aspect of the present invention is that unit 1 also comprises an actuating device 22, which cooperates with station 6 to move it in a direction parallel to portion P2 of path P, and is activated by control device 20 to adjust the position of station 6 as a function of the presence signal S generated by sensor 21. More specifically, the above adjustment is made by sliding stationing along a guide 23 shown schematically in FIG. 1.

Figure 2:
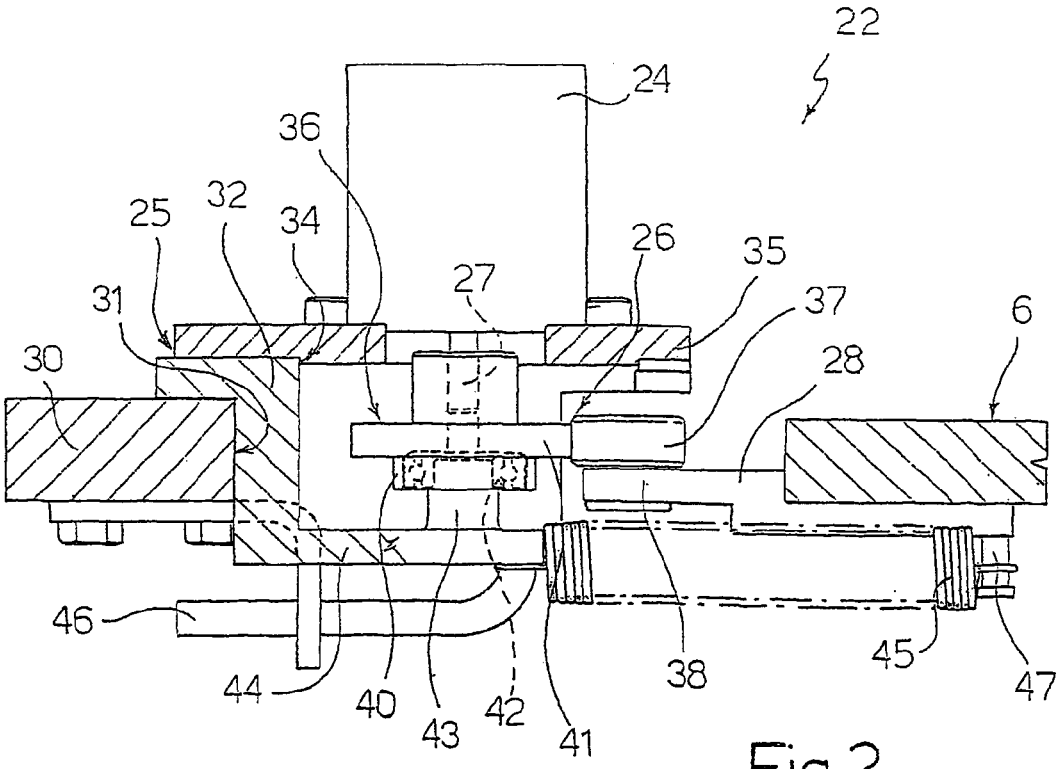
FIG. 2 shows a partly sectioned, larger-scale side view of an actuating assembly of the FIG. 1 unit.
Figure 3:
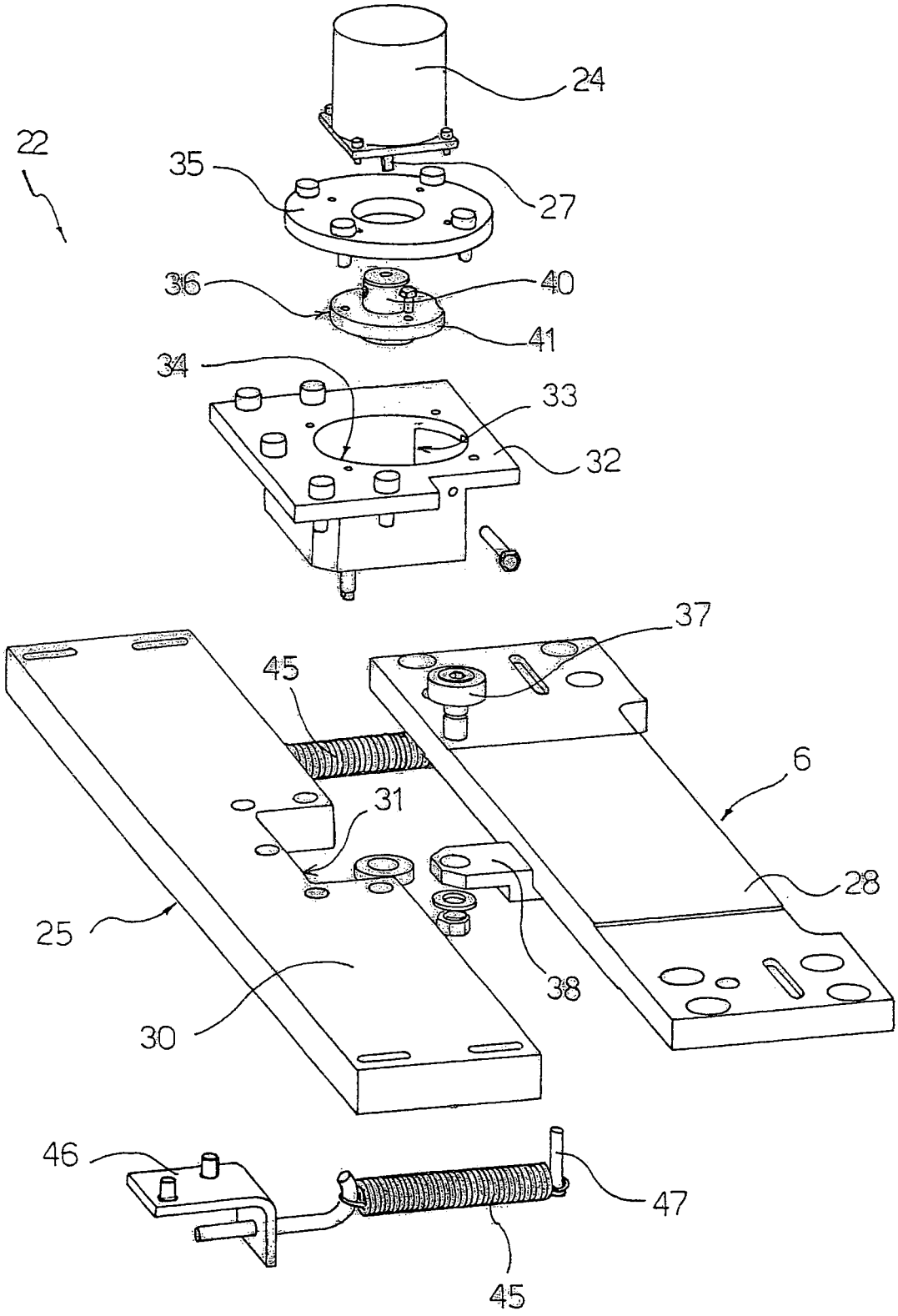
FIG. 3 shows a smaller-scale exploded view in perspective of the FIG. 2 actuating assembly.

With reference to FIGS. 2 and 3, actuating device 22 substantially comprises an electric step motor 24 carried by a fixed supporting structure 25; and a motion converting assembly 26 interposed between an output shaft 27 of motor 24 and a platelike structural portion 28 of station 6 to convert rotation of shaft 27 into linear displacement of station 6 in a direction parallel to portion P2 of path P.

More specifically, supporting structure 25 comprises a substantially rectangular base plate 30 defining a peripheral C-shaped cavity 31 facing structural portion 28 of station 6; and a substantially prismatic, cup-shaped member 32 fixed to plate 30 so as to engage cavity 31, and having a lateral opening 33 facing station 6, and a top opening 34 closed partly by an annular disk member 35 to which motor 24 is fixed coaxially.

As shown in FIGS. 2 and 3, shaft 27 engages disk member 35 with a certain amount of radial clearance, and projects inside cup-shaped member 32.

Assembly 26 comprises a cam member 36 fitted to shaft 27 and housed inside cup-shaped member 32; and a tappet roller 37 fitted in rotary and axially-fixed manner to an appendix 38 of structural portion 28 of station 6, and cooperating with cam member 36.

More specifically, cam member 36 is defined by a substantially cylindrical sleeve 40, from which a substantially annular, contoured flange 41 projects radially. Flange 41 has a cam profile defined by a curved line increasing gradually in radius, and the ends of which are joined by a substantially radial break portion.

Cam member 36—or more specifically sleeve 40—is fitted coaxially, with the interposition of a bearing 42, to a cylindrical appendix 43 projecting from a bottom wall 44 (FIG. 2), opposite top opening 34, of cup-shaped member 32.

Cam member 36 and tappet roller 37 are maintained contacting by two garter springs 45 interposed between plate 30 and structural portion 28 of station 6, and having respective axes parallel to portion P2 of path P. More specifically, each spring 45 has a first end fixed to a bracket 46 projecting from plate 30; and an opposite second end fixed to a pin 47 projecting from structural portion 28 of station 6.

With reference to FIG. 1, control device 20 receives presence signal S from sensor 21, and generates output signals C1, C2, C3, C4, C5 for controlling stations 3, 5, 6, feed device 10 and actuating device 22 respectively.

More specifically, to adjust the position of station 6 before each tab 8 is applied to a respective hole 4 in web 2, control device 20 implements the operations described below with reference to the logic block diagram in FIG. 5.

Figure 5:
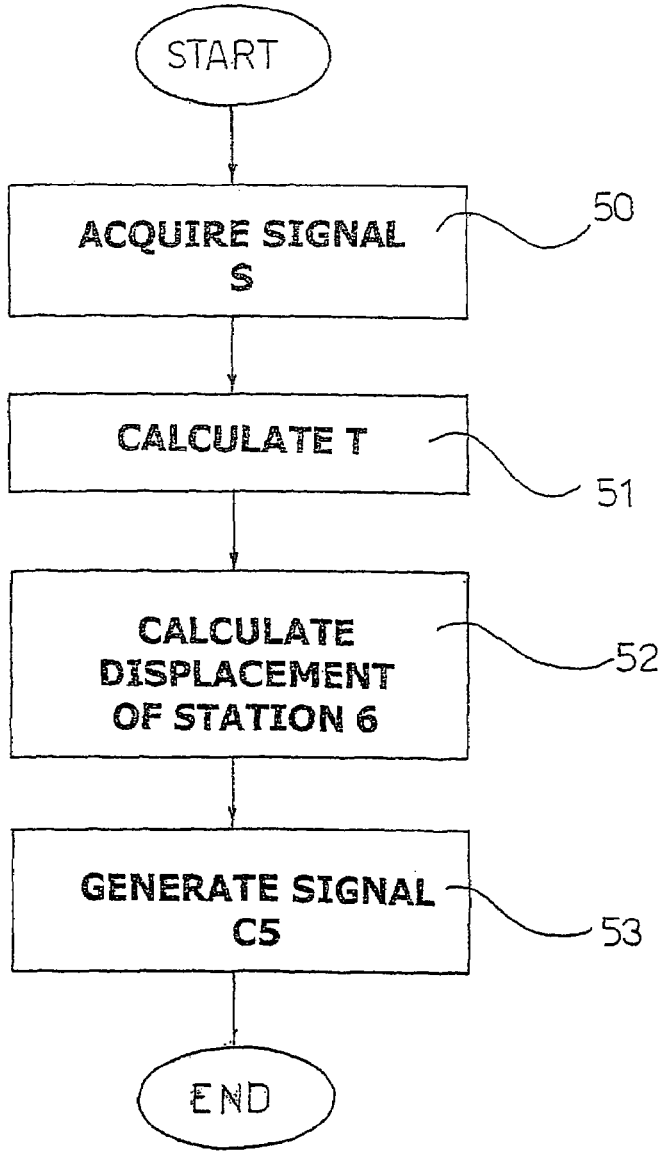
FIG. 5 shows a logic block diagram illustrating part of the operation of a control device on the FIG. 1 unit.

As shown in FIG. 5, control device 20 acquires presence signal S indicating the passage, past sensor 21, of a code C relative to a respective hole 4 in web 2 (block 50).

Control device 20 then processes presence signal S and calculates the absolute value and sign of the time T between the actual instant code C travels past sensor 21, and the expected or programmed instant in which passage should have occurred (block 51).

As a function of time T determined above and of the traveling speed of web 2, control device 20 calculates how far and in which direction cam member 36 of actuating device 22 must be rotated from its current angular position to achieve a work position of station 6 in which tab 8 is applied properly centered with respect to hole 4 (block 52). In other words, control device 20 calculates the absolute value and sign of how far station 6 must be moved by actuating device 22 for tab 8 to be heat sealed properly centered over respective hole 4.

As a function of the displacement determined above, control device 20 generates signal C5 to control motor 24 of actuating device 22 (block 53).

The advantages of unit 1 according to the present invention will be clear from the foregoing description.

In particular, detecting the actual location of each hole 4 in web 2 by means of sensor 21, and by adjusting the position of station 6 each time as a function of presence signal S generated by sensor 21, tabs 8 are applied properly centered over respective holes 4, thus ensuring optimum sealing of holes 4 and enabling a reduction in the size of tabs 8.

Clearly, changes may be made to unit 1 as described and illustrated herein without, however, departing from the scope of the accompanying Claims.

In particular, as opposed to codes C, sensor 21 may detect the passage of holes 4 themselves; in which case, sensor 21 may be located at any point, between stations 3 and 6, enabling the position of station 6 to be adjusted following detection and before station 6 is activated to apply a tab 8 over the detected hole 4.

Unit 1 may also comprise a further actuating device identical to actuating device 22 and controlled by control device 20 to adjust the position of station 5 in a direction parallel to portion P2 of path P.

Finally, different operations may be performed downstream from the punch operation; for example, the second operation may comprise injection molding closable opening devices directly onto respective holes 4 in web 2.

The invention claimed is:

1. A unit for processing a web of packaging material for producing sealed packages of pourable food products, said unit comprising:

at least a first station for forming a number of through holes in said web;

a second station for sealing said holes by applying respective opening devices by which to open the packages;

a feed device for step feeding said web along a path through said first station and said second station;

a position sensor generating a presence signal indicating the passage, past the sensor, of reference elements on said web;

control means for controlling said feed device in response to said presence signal;

wherein said reference elements bear a predetermined relationship with said holes in said web; and actuating means cooperating with said second station to move the second station in a direction parallel to said path, said actuating means being activated by said control means to adjust the position of the second station relative to a respective hole as a function of said presence signal, each time that a hole passes the position sensor, to compensate for a positional error of the respective hole so that a respective opening device is applied over the respective hole.

2. A unit as claimed in claim 1, wherein said control means comprise acquiring means for acquiring said presence signal; and generating means for generating an adjusting signal for said actuating means as a function of the time interval between the actual instant at which the passage of a said reference element past said sensor occurs, and an expected instant for said passage of said reference element past said sensor.

3. A unit as claimed in claim 2, wherein said control means comprise first calculating means for determining the absolute value and sign of said time interval; and second calculating means for determining, as a function of each said time interval and the traveling speed of said web, the absolute value and sign of the required displacement of said second station for each said opening device to be applied centrally over the respective said hole in said web.

4. A unit as claimed in claim 1, wherein said sensor is located close to said first station.

5. A unit as claimed in claim 1, wherein said sensor is located downstream from said first station along said path.

6. A unit as claimed in claim 1, wherein said reference elements are preprinted codes repeated along said web of packaging material.

7. A unit as claimed in claim 6, wherein said preprinted codes are bar codes.

8. A unit as claimed in claim 1, wherein said reference elements are defined by said holes formed at said first station.

9. A unit as claimed in claim 1, wherein each said opening device comprises a pull-off tab and a patch, which are sealed to each other and applied to opposite faces of said web at a respective said hole; said second station being a station for applying said pull-off tabs; and said unit also comprising a third station for applying said patches and interposed between said first and said second station.

10. A unit as claimed in claim 1, wherein said second station is mounted to slide along a guide in a direction parallel to said path;

and in that said actuating means comprise an electric motor, and cam and tappet means interposed between an output shaft of said motor and a structural portion of said second station.

11. A unit as claimed in claim 1, wherein said first station is connected to and controlled by said control means.

12. A unit as claimed in claim 1, further comprising:

a third station for applying a portion of the opening devices, said third station is interposed between said first station and said second station and controlled by said control means; and an actuating device controlled by said control means and which cooperates with said third station to adjust the position of said third station in a direction parallel to said path.

13. A unit as claimed in claim 12, wherein said position sensor is located between said second station and said third station.

14. A unit for processing a web of packaging material for producing sealed packages of pourable food products, the unit comprising:

at least a first station for forming through holes in the web;

a second station for sealing the holes by applying respective opening devices by which to open the packages;

a feed device for step feeding the web along a path through the first station and the second station;

a position sensor located downstream from the first station along the path, the sensor generating a presence signal indicating the passage, past the sensor, of the holes in the web;

control means for controlling the feed device in response to the presence signal; and actuating means cooperating with the second station to move the second station in a direction parallel to the path, the actuating means being activated by the control means to adjust the position of the second station relative to a respective hole as a function of the presence signal, each time that a hole Passes the position sensor, to compensate for a positional error of the respective hole so that a respective opening device is applied over the respective hole;

wherein the control means comprise acquiring means for acquiring said presence signal; and generating means for generating an adjusting signal for the actuating means as a function of the time interval between the actual instant at which the passage of a hole past the sensor occurs, and an expected instant for the passage of the hole past the sensor.

15. A unit as claimed in claim 14, wherein the control means comprise first calculating means for determining the absolute value and sign of the time interval; and second calculating means for determining, as a function of each time interval and the traveling speed of the web, the absolute value and sign of the required displacement of the second station for each opening device to be applied centrally over the respective hole in the web.

16. A unit as claimed in claim 14, wherein the sensor is located close to the first station.

17. A unit as claimed in claim 14, wherein each opening device comprises a pull-off tab and a patchy which are sealed to each other and applied to opposite faces of the web at a respective hole; the second station applying the pull-off tabs; and the unit also comprising a third station interposed between the first station and the second station for applying the patches to the web.

18. A unit as claimed in claim 14, wherein the second station is mounted to slide along a guide in a direction parallel to the path.

19. A unit as claimed in claim 14, wherein the first station is connected to and controlled by the control means.

20. A unit as claimed in claim 14, further comprising:

a third station for applying a portion of the opening devices, the third station is interposed between the first station and the second station and controlled by the control means; and an actuating device controlled by the control means and which cooperates with the third station to adjust the position of the third station in a direction parallel to the path.

21. A unit as claimed in claim 20, wherein the position sensor is located between the second station and the third station.

22. A unit for processing a web of packaging material for producing sealed packages of pourable food products, the unit comprising:

at least a first station that forms through holes in the web;

a second station that seals the holes by applying respective opening devices by which to open the packages;

a feed device that step feeds the web along a path through the first station and the second station;

a position sensor that generates a presence signal indicating the passage, past the sensor, of the holes on the web;

a control device that controls the feed device in response to the presence signal; and an actuating device that cooperates with the second station to move the second station in a direction parallel to the path during processing of the web, the actuating device being activated by the control device to adjust the position of the second station along the path relative to a respective hole of the web as a function of the presence signal to compensate for a positional error of the respective hole so that a respective opening device is applied over the respective hole.

23. A unit as claimed in claim 22, wherein the control device is operable to acquire the presence signal and to generate an adjusting signal for the actuating device as a function of the time interval between the actual instant at which the passage of a hole past the sensor occurs, and an expected instant for the passage of the hole past the sensor.

24. A unit as claimed in claim 23, wherein the control device is operable to determine the absolute value and sign of the time interval and to determine, as a function of each time interval and the traveling speed of the web, the absolute value and sign of the required displacement of the second station for each opening device to be applied over the respective hole in the web.

25. A unit as claimed in claim 22, wherein the sensor is located downstream from and close to the first station along the path, and the second station is mounted to slide along a guide in a direction parallel to the path.

26. A unit as claimed in claim 22, wherein each opening device comprises a pull-off tab and a patch, which are sealed to each other and applied to opposite faces of the web at a respective hole; the second station applies the pull-off tabs; and the unit further comprises a third station between the first station and the second station that applies the patches.

27. A unit as claimed in claim 22, wherein the first station is connected to and controlled by the control device.

28. A unit as claimed in claim 22, further comprising:

a third station for applying a portion of the opening devices, the third station is interposed between the first station and the second station and controlled by the control device; and an actuating device controlled by the control device and which cooperates with the third station to adjust the position of the third station in a direction parallel to the path.

29. A unit as claimed in claim 28, wherein the position sensor is located between the second station and the third station.

30. A unit as claimed in claim 22, wherein the actuating device is activated by the control device to adjust the position of the second station along the path relative to a respective hole of the web as a function of the presence signal, each time that a hole passes the position sensor, to compensate for a positional error of the respective hole so that the respective opening device is applied over the respective hole.

31. A unit for processing a web of packaging material, the unit comprising:

a first station that forms through holes in the web;

a second station that seals the holes by applying respective opening devices to the web;

a feed device that feeds the web along a path through the first station and the second station;

a position sensor located downstream from the first station along the path, the sensor generating a signal indicating the passage, past the sensor, of the holes in the web;

a control device that controls the first station, second station, position sensor and feed device; and an activating device controlled by the control device to move the second station parallel to the path during processing of the web, the control device activates the activating device to adjust the position of the second station relative to a respective hole of the web as a function of the signal to compensate for a positional error of the respective hole so that a respective opening device is applied over the respective hole.

32. A unit as claimed in claim 31, wherein the control device is operable to acquire the signal and to generate an adjusting signal for the actuating device as a function of the time interval between the actual instant at which the passage of a hole past the sensor occurs, and an expected instant for the passage of the hole past the sensor.

33. A unit as claimed in claim 31, wherein the control device activates the activating device to adjust the position of the second station relative to the respective hole of the web as a function of the signal, each time a hole passes the position sensor, to compensate for a positional error of the respective hole so that the respective opening device is applied over the respective hole.

* * * * *